United States Patent [19]

Achelpohl et al.

[11] 4,065,049

[45] Dec. 27, 1977

[54] MULTI-LAYER BAG OPEN AT ONE SIDE

[75] Inventors: Fritz Achelpohl; Herbert Schmedding, both of Lengerich, Germany

[73] Assignee: Windmoller & Holscher, Lengerich, Germany

[21] Appl. No.: 639,710

[22] Filed: Dec. 11, 1975

[30] Foreign Application Priority Data

Dec. 30, 1974 Germany ..... 2461828

[51] Int. Cl.[2] ..... B65D 33/02

[52] U.S. Cl. ..... 229/55; 229/56

[58] Field of Search ..... 229/55, 53, 56

[56] References Cited

U.S. PATENT DOCUMENTS

| | | | |
|---|---|---|---|
| 2,737,339 | 3/1956 | Doyle | 229/55 |
| 2,898,027 | 8/1959 | Scholle | 229/55 X |
| 3,038,651 | 6/1962 | Cloudsley | 229/55 |
| 3,112,057 | 11/1963 | Lipschutz et al. | 229/55 X |
| 3,958,749 | 5/1976 | Goodrich | 229/55 |

FOREIGN PATENT DOCUMENTS

| | | | |
|---|---|---|---|
| 214,352 | 4/1961 | Austria | 229/53 |
| 533,307 | 9/1955 | Italy | 229/55 |

*Primary Examiner*—Stephen P. Garbe
*Attorney, Agent, or Firm*—Fleit & Jacobson

[57] ABSTRACT

In a composite bag consisting of a paper or plastics outer envelope of one or more plies and a plastics inner envelope, the latter is closed at the base by a weld seam, the inner envelope material being incorporated in a welded or stitched base closure seam for the outer envelope. A line of weakness in the inner envelope material is disposed between the weld seam of the inner envelope and the base closure seam of the outer envelope.

3 Claims, 5 Drawing Figures

MULTI-LAYER BAG OPEN AT ONE SIDE

The invention relates to a bag open at one side, comprising a single or multi-ply outer bag of paper or plastics material and an inner bag of plastics film provided with a base weld seam and a Z fold.

In a method known from DT-AS 2,244,697 for making such a bag, a blank for the inner bag provided with a base weld seam and a Z fold is inserted in an outer bag tube section at such a spacing from the base end thereof that the outer bag can be provided with a base fold independently of the inner bag. In the known bag, the inner bag can be pulled out of the outer bag after it has been emptied so that the outer bag can be re-used without fear of soiling by remnants of the substance that had been contained in the inner bag. If, however, the inner bag is not connected to the outer bag during manufacture, there is a danger that when first filling the inner bag the latter does not lie intimately against the outer bag and consequently the inner bag having only little strength is not adequately supported by the outer bag. If the inner bag is fixed to the outer bag by dabs of adhesive during manufacture, as is provided for in the method known from DT-AS 2,244,697 for the purpose of securing the inner bags, there is a danger of damaging the inner bag as it is removed from the outer bag when it is desired to use the outer bag for a second time.

The object of the present invention is to dispose the inner bag in the outer bag in a readily removable manner for the purpose of re-use of the outer bag, one being sure that the inner bag lies well against the outer bag during its first use for the purpose of supporting same particularly in the base region.

According to the invention, this object is achieved in a bag of the aforementioned kind in that the inner bag is connected in a manner known per se to the base seam of the outer bag and that a tear-off line of weakness is provided between the base seam of the outer bag and the base weld seam of the inner bag. By means of the base weld seam of the inner bag, one ensures in the bag according to the invention that the substance for the first time filled into the bag will settle in in a dust and watertight manner. The connection of the base of the inner bag to the base of the outer bag ensures that the inner bag will lie well against the outer bag whilst it is being filled so that the outer bag supports the inner bag in a load-bearing manner. After the bag has been emptied, the inner bag can be easily released from the outer bag along the tear-off line of weakness so that the outer bag can be re-used without its inner walls becoming soiled by the first filling material.

US-PS 2,803,173 discloses a multi-ply bag with an inner bagprovided with a Z fold for stretching the filling end of the inner bag. This known bag is closed at its base by a stitched seam which goes through the outer and inner bag as well as a so-caled rider strip. Such a seam considerably reduces the gas and steam tightness of the plastics inner bag which, after it has been emptied, can also not be readily released from the outer bag and without soiling same with residues of the filled material.

A multi-ply bag comprising an inner bag provided with a Z fold and having its base closed by a weld seam is known from DT-PS 1,611,710. The inner bag is, however, securely connected to the base of the outer bag and cannot be simply released therefrom without soiling same with residues of the first filling. The known bags therefore do not render the bag according to the invention obvious.

The tear-off line of weakness of the inner bag can consist of a transverse perforation.

The bag closure seam of the outer bag can be guided by a rider strip-like reinforcing strip placed thereover. If the outer bag consists of weldable material, the bag closure seam can likewise be desirably formed as a weld seam.

The method for making the bags according to the invention is characterised in that the tube for the inner bag is withdrawn from a supply roll, provided with a tear-off line of weakness and a transverse weld seam adjacent thereto as well as with a Z fold, and applied to a web of material which is withdrawn from a supply roll and forms the outer bag, that the outer edges of the web of material are then folded onto and connected by adhesion or welding to its central portion or the transversely perforated transversely folded inner tube provided with a Z fold, and that the tube sections are severed from this multi-layer tubular web adjacent the perforated seam of the inner bag and closed at one end by stitching or welding.

An example of the invention will now be described in more detail with reference to the drawing. In the drawing.

Figure 2:
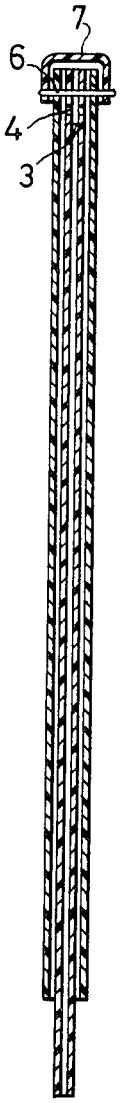
FIG. 2 is a diagrammatic longitudinal section through a an outer bag with a base seam sewn together with a rider strip.
Figure 1:
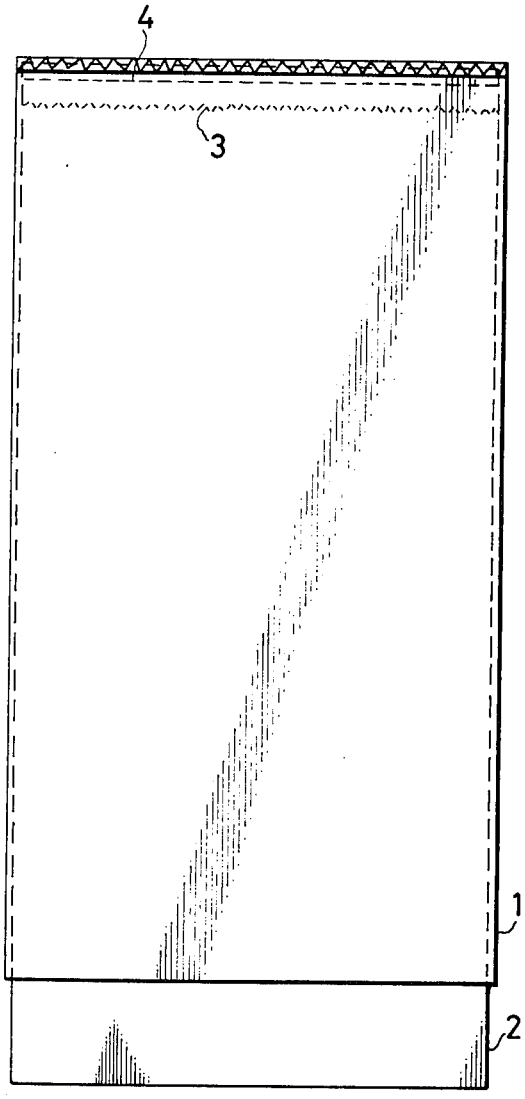
FIG. 1 is a diagrammatic side elevation of a an outer bag with inner bag.
Figure 3:
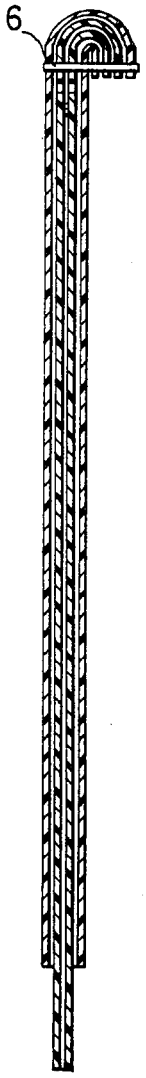
FIG. 3 is a longitudinal section through a an outer bag which has been folded over in the region of the base seam.
Figure 4:
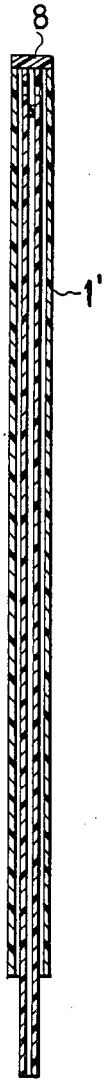
FIG. 4 is a longitudinal section through a bag with an outer bag welded at the base.
Figure 5:
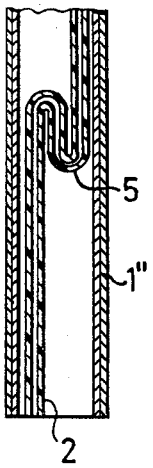
FIG. 5 is a longitudinal section through a multi-layer bag with an inner bag provided with a Z fold.

FIG. 1 is a side elevation of a bag consisting of an outer bag 1 and an inner bag 2. The outer bag 1 is comprised of a plastic envelope 1', as shown in FIGS. 2–4 or a paper envelope 1'', as shown in FIG. 5. The envelope is comprised of at least one ply of material. The inner bag 2 comprises a weld seam 3, a line 4 of perforations and a Z fold 5. In FIG. 2 the base edge if formed by a stitched seam 6 which is reinforced by a rider strip 7. In FIG. 3 the base bag is folded over together with the inner bag to form a base fold. The stitched seam 6 goes through the folded-over double layers forming the outer bag 1 and inner bag 2. In FIG. 4 the outer bag is also made from weldable material. The base edge is in this example formed by a weld seam 8 which engages both the outer and the inner bag.

For filling purposes, the Z fold is stretched so that the inner bag projects from the outer bag 1 as shown in FIGS. 1 to 4. The bag can be conveniently filled in this position and the inner bag 2 can be closed independently of the outer bag 1. The outer bag 1 is closed or stitched shut after the projecting portion of the inner bag 2 has been shortened by folding or rolling.

By means of the construction according to the invention, the inner bag 2 lies intimately against the outer bag 1 in the region of the base fold. After use, the inner bag 2 can be removed from the outer bag 1 by severing it along the line 4 of perforations from the strip that is connected to the base fold.

We claim:

1. A bag open at one side, comprising an outer bag of at least one ply of paper and having a base seam and an inner bag of plastics film provided with a base weld seam at a first end and a Z fold at a second end wherein the first end of the inner bag is securely fastened to the base seam of the outer bag and having a tear-off line of weakness disposed between the base seam of the outer bag and the base weld seam of the inner bag.

2. A bag according to claim 1, wherein the base seam of the outer bag is formed by placing a rider strip-like reinforcing strip thereover and fastening the outer bag and the inner bag and the rider strip together.

3. A bag open at one side, comprising an outer bag of at least one ply of plastics material and having a base seam formed as a weld seam and an inner bag of plastics film provided with a base weld seam at a first end and a Z fold at a second end wherein the first end of the inner bag is securely fastened to the base seam of the outer bag and having a tear-off line of weakness disposed between the base seam of the outer bag and the base weld seam of the inner bag.

* * * * *